US005373940A

United States Patent [19]

Hillelson

[11] Patent Number: 5,373,940

[45] Date of Patent: Dec. 20, 1994

[54] LIPSTICK-PILL BOX CONTAINER

[76] Inventor: June D. Hillelson, 4057 Woodland Creek Dr. SE #302, Kentwood, Mich. 49512

[21] Appl. No.: 194,063

[22] Filed: Feb. 9, 1994

[51] Int. Cl.[5] ..... B65D 85/72

[52] U.S. Cl. ..... 206/385; 206/38; 132/318; 401/78

[58] Field of Search ..... 206/38, 385; 132/317, 132/318; 401/71, 74, 78, 80

[56] References Cited

U.S. PATENT DOCUMENTS

| | | | |
|---|---|---|---|
| D. 279,828 | 7/1985 | Buchet . | |
| 1,953,251 | 4/1934 | Mitchell | 132/318 |
| 2,110,999 | 3/1938 | Miga | 206/38 |
| 2,610,733 | 9/1952 | Balasevich | 132/318 |
| 2,753,991 | 7/1956 | Sherman | 401/78 |
| 2,964,170 | 12/1960 | Otto et al. | 401/78 |
| 3,438,714 | 4/1969 | Seaver | 401/74 |
| 3,817,372 | 6/1974 | Smith . | |
| 4,253,572 | 3/1981 | Halbich . | |
| 4,326,546 | 4/1982 | Acker . | |
| 4,812,066 | 3/1989 | Gueret | 401/78 |
| 4,888,667 | 12/1989 | Hwang . | |
| 5,002,179 | 3/1991 | Dhalla | 206/38 |

FOREIGN PATENT DOCUMENTS

| | | | |
|---|---|---|---|
| 998453 | 9/1951 | France | 206/385 |

*Primary Examiner*—David T. Fidei

[57] ABSTRACT

An elongate container structure that is coaxially aligned includes a lipstick tube structure arranged to direct the lipstick tube from within the container at a first end of a central hub, with a second end of the central hub having a removable storage container arranged to contain medicament, coins, or the like therein.

4 Claims, 3 Drawing Sheets

LIPSTICK-PILL BOX CONTAINER

BACKGROUND OF THE INVENTION

1. Field of the Invention

The field of invention relates to lipstick container structure, and more particularly pertains to a new lipstick-pill box container wherein the same is directed for the storage of lipstick and medicament therefrom.

2. Description of the Prior Art

Lipstick containers and pill box containers are indicated in the prior art such as exemplified by the U.S. Pat. Nos. 4,888,667; 3,817,372; 4,253,572; and 4,326,546.

The instant invention attempts to overcome deficiencies of the prior art by providing for a lipstick container arranged to conveniently and efficiently store selectively medicament and/or coins therewithin and in this respect, the present invention substantially fulfills this need.

SUMMARY OF THE INVENTION

In view of the foregoing disadvantages inherent in the known types of container apparatus now present in the prior art, the present invention provides a lipstick-pill box container wherein the same is arranged to store lipstick and medication selectively from an individual container structure. As such, the general purpose of the present invention, which will be described subsequently in greater detail, is to provide a new lipstick-pill box container apparatus and method which has many of the advantages of the prior art listed heretofore and many novel features that result in a lipstick-pill box container apparatus which is not anticipated, rendered obvious, suggested, or even implied by any of the prior art, either alone or in any combination thereof.

To attain this, the present invention provides an elongate container structure that is coaxially aligned which includes a lipstick tube structure arranged to direct the lipstick tube from within the container at a first end of a central hub, with a second end of the central hub having a removable storage container arranged to contain medicament, coins, or the like therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent and legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lipstick-pill box container apparatus and method which has many of the advantages of the prior art listed heretofore and many novel features that result in a lipstick-pill box container apparatus which is not anticipated, rendered obvious, suggested, or even implied by any of the prior art, either alone or in any combination thereof.

It is another object of the present invention to provide a new lipstick-pill box container which may be easily and efficiently manufactured and marketed.

It is a further object of the present invention to provide a new lipstick-pill box container which is of a durable and reliable construction.

An even further object of the present invention is to provide a new lipstick-pill box container which is susceptible of a low cost of manufacture with regard to both materials and labor, and which accordingly is then susceptible of low prices of sale to the consuming public, thereby making such lipstick-pill box containers economically available to the buying public.

Still yet another object of the present invention is to provide a new lipstick pill box container which provides in the apparatuses and methods of the prior art some of the advantages thereof, while simultaneously overcoming some of the disadvantages normally associated therewith.

Yet still another object of the present invention is to provide a new lipstick pill box container in the form of an elongate container structure that includes a lipstick tube structure arranged to direct the lipstick tube from within the container at a first end of a central hub, with a second end of the central hub having a removable storage container arranged to contain medicament, coins, or the like therein An even further object of the present invention is to provide a new lipstick pill box container in the form of an elongate container structure that includes a coaxially aligned removable storage container having a partition therein to define separate compartments.

These together with other objects of the invention, along with the various features of novelty which characterize the invention, arc pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
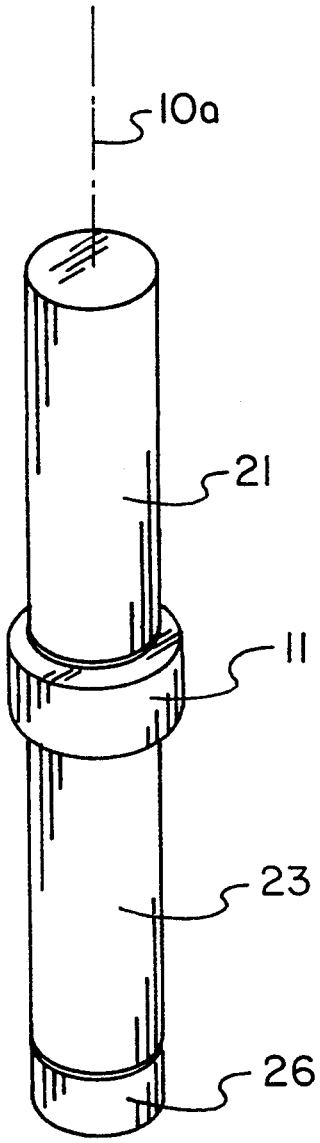
FIG. 1 is an isometric illustration of the invention.

With reference now to the drawings, and in particular to FIGS. 1–5 thereof, a new lipstick-pill box container embodying the principles and concepts of the present invention and generally designated by the reference numeral 10 will be described.

Figure 5:
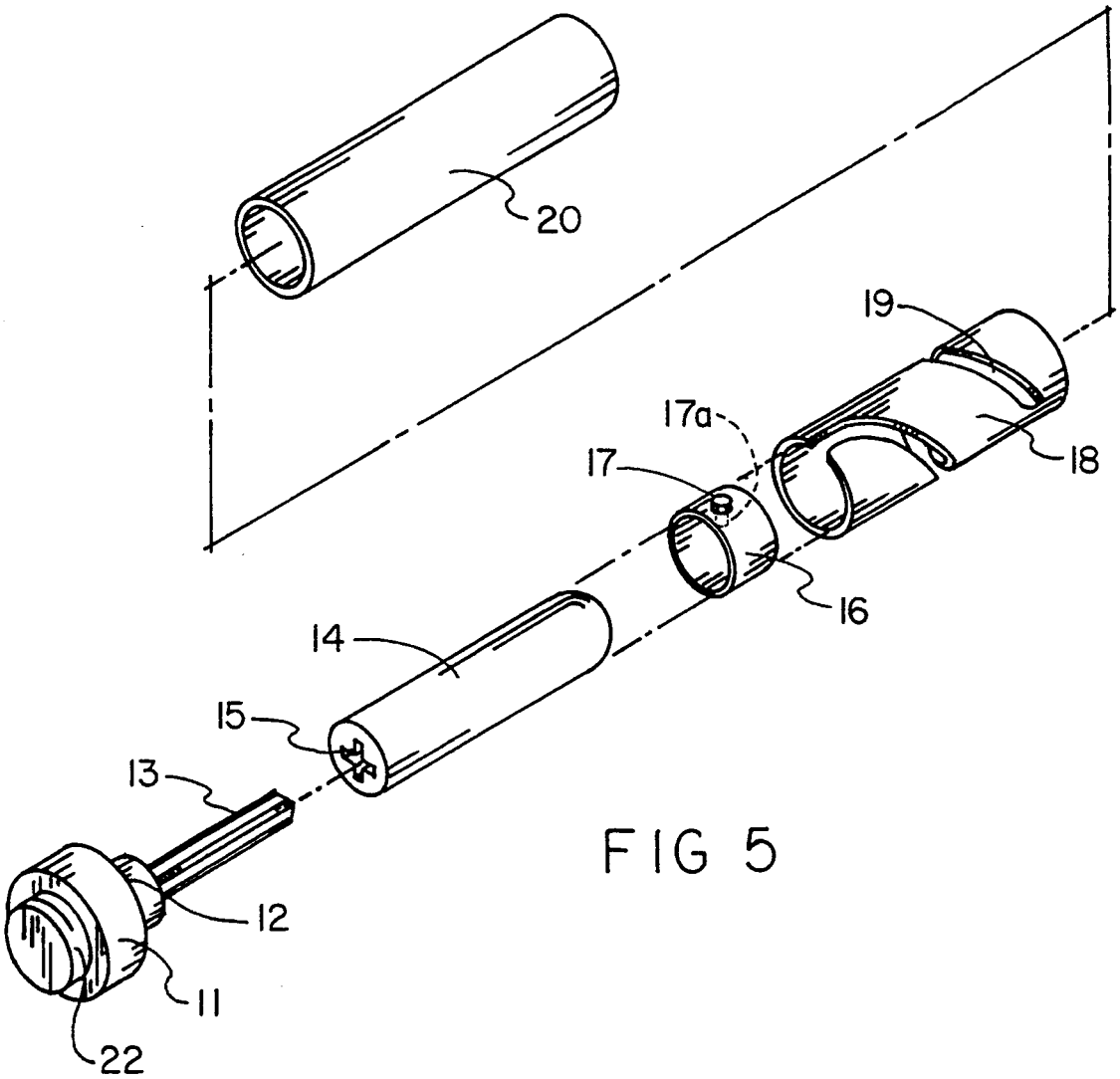
FIG. 5 is an isometric, exploded illustration of a portion of the present invention.

More specifically, and as illustrated in FIG. 5, the lipstick-pill box container 10 of the instant invention comprises a lipstick compartment formed of a central hub 11 including a first cylindrical boss 12 secured to a first side of the hub 11. An elongate ribbed support 13 is fixedly mounted to the first cylindrical boss 12 for reception within a ribbed cavity 15 of the lipstick 14. A clamp ring 16 is secured to the lipstick 14 by a fastener shank 17*a* forming a portion of a fastener head 17 that projects exteriorly of the clamp ring 16. The fastener head 17 is arranged for reception within a helical slot 19 of an elevator tube 18 that extends in surrounding relationship about the lipstick 14.

The elevator tube 18 is mounted onto the first cylindrical boss 12 in a coaxially aligned relationship and the lipstick 14 is slidably mounted along the ribbed support 13, such that upon rotation of the elevator tube 18, the clamp ring 16 is directed longitudinally along the elevator tube as it slides from the ribbed support 13 for extension of the lipstick tube 14 prior to use thereof. A tubular sleeve 20 covers the elevator tube 19 and extends along the elevator tube to the central hub 11, as illustrated in FIG. 2. In addition, a tubular cap 21 is arranged for receiving the elevator tube 18, with the tubular sleeve 20 fitting coextensively within the tubular cap 21, as illustrated in FIGS. 1 and 2.

Figure 2:
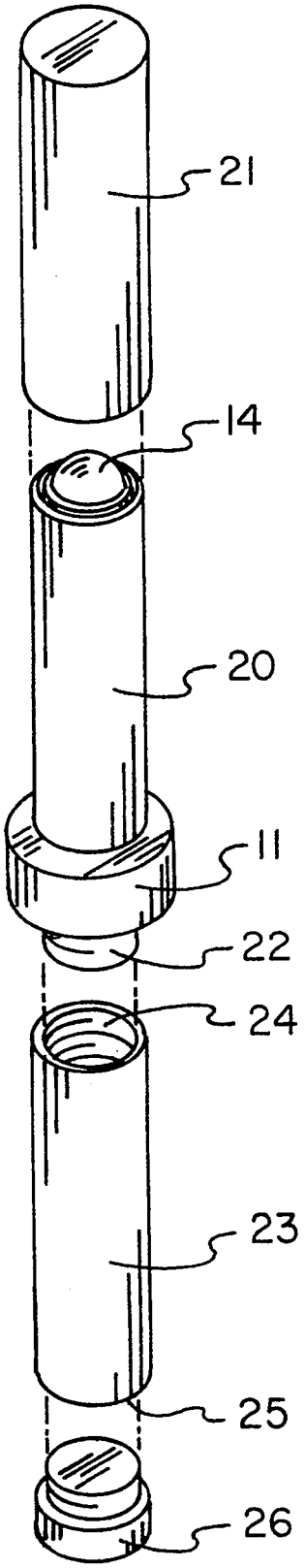
FIG. 2 is an isometric illustration of the invention having the storage container and lipstick cap separated relative to the container structure.

A storage compartment is arranged beneath the lipstick compartment, as shown in FIGS. 1 and 2. The storage compartment comprises a second cylindrical boss 22 coaxially aligned with the first cylindrical boss 12 such that the second cylindrical boss 22 is fixedly mounted to the central hub at an opposed, second side of the central hub. An internally threaded cylindrical storage tube 23 is arranged for securement to the externally threaded second cylindrical boss 22.

Figure 4:
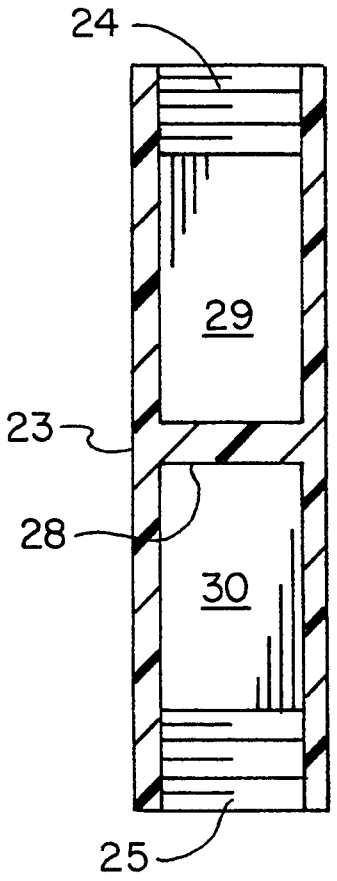
FIG. 4 is a cross sectional view, taken along lines 4—4 of FIG. 3 in the direction indicated by the arrows.

As best illustrated in FIG. 4, the storage tube 23 is formed with a first end 24 spaced from a second end 25 such that an internally threaded first portion extends from the first end 24 within the storage tube, and an internally threaded second portion 25 extends from the second end 25 within the storage tube 23, such that the first end 24 is arranged for securement about the second cylindrical boss 22, with a second end cap 26 being threadably received within the second end 25. The lipstick compartment and the storage compartment cooperate to form a symmetric configuration of the container structure 10 about an axis 10*a*.

Figure 3:
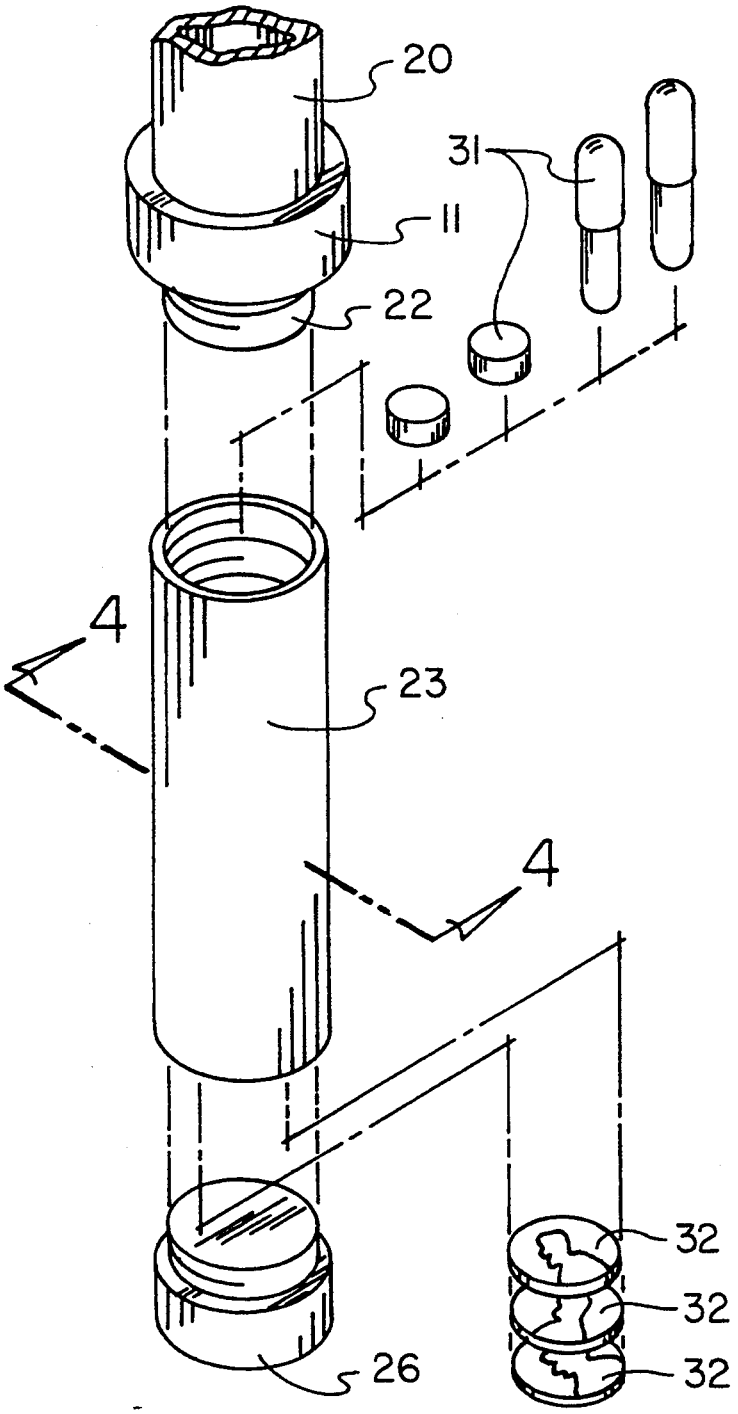
FIG. 3 is an enlarged exploded illustration of the storage structure.

A partition wall 28, such as illustrated in the FIG. 4, divides the storage tube into respective first and second chambers 29 and 30 for receiving medication tablets 31 or currency coins 32 within respective first and second chambers 29 and 30, such as is illustrated in FIGS. 3 and 4. It will be appreciated that the separate compartments defined by chambers 29 and 30 may be used to store other useful articles as well.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lipstick-pill box container comprising:

a central hub, the central hub having first and second sides thereof with a first cylindrical boss positioned on the first side of the central hub, and an externally threaded second cylindrical boss positioned on the second side of the central hub, with the first cylindrical boss and the second cylindrical boss being coaxially aligned relative to one another;

an elongate ribbed support fixedly mounted to the first cylindrical boss and coaxially aligned with the first cylindrical boss;

a lipstick member having a ribbed cavity complementarily and slidably receiving the ribbed support therewithin;

a clamp ring secured to the lipstick, the clamp ring including a fastener shank directed through the clamp ring in engagement with the lipstick member, with the fastener shank having a fastener head projecting exteriorly of the clamp ring;

an elevator tube having a helical slot receiving the fastener head therewithin, whereupon rotation of the elevator tube, the clamp ring and lipstick member are longitudinally directed through the elevator tube;

a tubular sleeve receiving complementarily the first cylindrical boss and the elevator tube and the clamp ring therewithin;

a cylindrical storage tube coaxially aligned with the second cylindrical boss, the tube having a first end threadably receiving the second cylindrical boss therewithin, and a second end and, a second end cap threadably received within the second end of the storage tube.

2. The container as set forth in claim 1, wherein the storage tube and the tubular sleeve are arranged to form a symmetric configuration about an axis.

3. The container as set forth in claim 2, and further comprising a partition wall, the partition wall being positioned within the storage tube to divide the storage tube into first and second chambers.

4. The container as set forth in claim 3 wherein said partition wall extends orthogonally with respect to said axis whereby said first and second chambers are coaxially aligned.

* * * * *